US008267671B2

(12) United States Patent
Soeda et al.

(10) Patent No.: US 8,267,671 B2
(45) Date of Patent: Sep. 18, 2012

(54) VARIABLE DISPLACEMENT PUMP

(75) Inventors: Jun Soeda, Fujisawa (JP); Yukio Uchida, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 936 days.

(21) Appl. No.: 12/206,903

(22) Filed: Sep. 9, 2008

(65) Prior Publication Data

US 2009/0081052 A1 Mar. 26, 2009

(30) Foreign Application Priority Data

Sep. 21, 2007 (JP) ..... 2007-244736

(51) Int. Cl.
*F04B 49/00* (2006.01)

(52) U.S. Cl. ..... 417/220; 418/30

(58) Field of Classification Search ..... 417/219, 417/220; 418/30, 31

See application file for complete search history.

(56) References Cited

U.S. PATENT DOCUMENTS

| | | | | |
|---|---|---|---|---|
| 4,007,663 | A * | 2/1977 | Nagatomo et al. | 91/6.5 |
| 4,531,893 | A * | 7/1985 | Okoh et al. | 417/220 |
| 6,280,150 | B1 * | 8/2001 | Miyazawa | 417/220 |
| 6,524,076 | B2 * | 2/2003 | Konishi | 417/213 |
| 2001/0036412 | A1 | 11/2001 | Konishi | |
| 2004/0105768 | A1 * | 6/2004 | Cameron et al. | 417/420 |
| 2007/0212243 | A1 * | 9/2007 | Yamamuro et al. | 418/30 |

FOREIGN PATENT DOCUMENTS

| | | | |
|---|---|---|---|
| DE | 101 20 252 | A1 | 1/2002 |
| DE | 10 2006 004 311 | A1 | 8/2007 |
| JP | 2001-304139 | A | 10/2001 |

* cited by examiner

*Primary Examiner* — Devon Kramer
*Assistant Examiner* — Ryan Gatzemeyer
(74) *Attorney, Agent, or Firm* — Foley & Lardner LLP

(57) ABSTRACT

A variable displacement pump includes: a pump body; a rotor; a cam ring; inlet and outlet ports; first and second fluid pressure chambers; a metering orifice provided in a discharge passage connected with the outlet port; a pressure regulating section arranged to regulate the pressure introduced into the first or second fluid pressure chamber, and including a high pressure chamber, a middle pressure chamber, and a low pressure chamber; a relief valve; a pilot orifice provided in a passage connecting the metering orifice and the middle pressure chamber, and having a circular section with a diameter of a mm; and a damper orifice provided in a passage connecting the outlet port and the high pressure chamber, and having a circular section with a diameter of b mm. The pilot orifice and the damper orifice satisfy the following relationships: $a+2b-2.1 \geqq 0$, $-4a+b-16.3 \leqq 0$, and $a \leqq 1.8$.

20 Claims, 8 Drawing Sheets

| | | PILOT ORIFICE (mm) | | | | | | |
|---|---|---|---|---|---|---|---|---|
| | | 1.1 | 1.3 | 1.4 | 1.5 | 1.6 | 1.7 | 1.8 |
| DAMPER ORIFICE (mm) | 1.1 | | | | | | | |
| | 1.2 | | | | | | | |
| | 1.3 | | | | | | | |
| | 1.4 | | | | | | | |
| | 1.5 | | | | | | | |
| | 1.6 | | | | | | | |
| | 1.7 | | | | | | | |
| | 1.8 | | | | | | | |
| | 1.9 | | | | | | | |
| | 2.0 | | | | | | | |

FIG.8

| | | PILOT ORIFICE (mm) | | | | | | |
|---|---|---|---|---|---|---|---|---|
| | | 1.1 | 1.3 | 1.4 | 1.5 | 1.6 | 1.7 | 1.8 |
| DAMPER ORIFICE (mm) | 1.1 | | | | | | | |
| | 1.2 | | | | | | | |
| | 1.3 | | | | | | | |
| | 1.4 | | | | | | | |
| | 1.5 | | | | | | | |
| | 1.6 | | | | | | | |
| | 1.7 | | | | | | | |
| | 1.8 | | | | | | | |
| | 1.9 | | | | | | | |
| | 2.0 | | | | | | | |

FIG.9

| | | PILOT ORIFICE (mm) | | | | | | |
|---|---|---|---|---|---|---|---|---|
| | | 1.1 | 1.3 | 1.4 | 1.5 | 1.6 | 1.7 | 1.8 |
| DAMPER ORIFICE (mm) | 1.1 | | | | | | | |
| | 1.2 | | | | | | | |
| | 1.3 | | | | | | | |
| | 1.4 | | | | | | | |
| | 1.5 | | | | | | | |
| | 1.6 | | | | | | | |
| | 1.7 | | | | | | | |
| | 1.8 | | | | | | | |
| | 1.9 | | | | | | | |
| | 2.0 | | | | | | | |

VARIABLE DISPLACEMENT PUMP

BACKGROUND OF THE INVENTION

This invention relates to a variable displacement pump used as a hydraulic source and so on of a power steering apparatus of a vehicle.

U.S. Pat. No. 6,524,076 B2 (corresponding to Japanese Patent Application Publication No. 2001-304139) shows a variable displacement pump for a power steering apparatus of a vehicle. This variable displacement pump includes an adapter ring disposed in a pump body; a cam ring disposed radially inside the adapter ring, and arranged to swing about a support shaft disposed in an axial direction at a lower portion of an inner circumference surface of the adapter ring; a drive shaft rotatably supported through forward and rearward bearing bushes in the pump body; and a rotor connected with the drive shaft by a serration portion located at a substantially central portion of the drive shaft in the axial direction, and arranged to rotate within the cam ring.

In an outer circumference portion of the rotor, there are provided a plurality of vanes each moved in the radial direction from one of a plurality of slots formed in the radial directions. Moreover, there is provided a pressure plate sandwiching the cam ring and the rotor with the rear body in the axial direction. The pressure plate is formed with an inlet port opened in a region in which the volumes of the pump chambers are increased, and an outlet port opened in a region in which the volumes of the pump chambers are decreased.

Moreover, there are formed a first fluid pressure chamber and a second fluid pressure chamber radially outside the cam ring, on the both sides of the cam ring. There is provided a pressure regulating valve arranged to regulate the pressure introduced into the first fluid pressure chamber or the second fluid pressure chamber. Within the pressure regulating valve, there is provided a relief valve arranged to relieve to the pump induction side when the fluid pressure of the pump discharge pressure is equal to or greater than a predetermined value.

Moreover, in the discharge passage connected with the outlet port, there is provided a metering orifice arranged to regulate the discharge flow rate to the power steering apparatus. Furthermore, in a branch passage bifurcated from the downstream side of the metering orifice, and connected with the relief valve, there is provided a pilot orifice. This pilot orifice is arranged to regulate the flow rate which the relief valve relieves when the pump discharge quantity is increased.

Although this patent document of the earlier technology does not disclose, in a passage connecting the outlet port and the high pressure chamber of the pressure regulating valve, there is provided a damper orifice arranged to decrease the pressure pulsation of the fluid pressure introduced into the high pressure chamber.

The pressure difference between the forward side and the rearward side of the metering orifice is introduced into the first and second fluid pressure chambers. Consequently, the cam ring is swung in one direction, and the volumes of the pump chambers are varied to regulate the pump discharge quantity.

SUMMARY OF THE INVENTION

In a case of using the variable displacement pump of the earlier technology as the hydraulic source of the power steering apparatus of the vehicle, the eccentric quantity of the swing movement of the cam ring is maximized and the pump discharge quantity is maximized at the stationary steering (static steering) of the steering wheel at the low rotational speed of the pump. In this case, the pressure of the power steering apparatus is increased, and accordingly the internal pressure of the pump chamber on the discharge side is increased. Therefore, the pressurized fluid in the discharge passage is returned from the pilot orifice through the relief valve to the reservoir tank to circulate through (around) the inside. Accordingly, the excessive increase of the pump chamber is suppressed.

In this case, the relief quantity of the fluid is decreased as the orifice diameter of the pilot orifice is decreased, so that the useless internal circulation is suppressed. Consequently, it is possible to decrease the pump torque, and to improve the energy conservation by decreasing the calorific (heat) value.

However, in a case in which the diameter of the pilot orifice is excessively decreased, the relief quantity is decreased, and the vibration tends to be caused by opening and closing repeat operations of the ball valve element of the relief valve. The pressure variation or pressure fluctuation may be increased by the vibration of overall spool valve of the pressure regulating valve.

On the other hand, in a case in which the damper orifice has a small diameter, it is possible to suppress the pressure variation of the high pressure chamber of the pressure regulating valve, to effectively prevent the pulsation, and to prevent the vibration of the relief valve. However, in a case in which the diameter of the damper orifice is excessively decreased, the high pressure chamber on the downstream side of the damper orifice becomes the low pressure at the high discharge pressure of the pump. Consequently, the spool valve prevents introduction of the fluid pressure to the first fluid chamber. The eccentric quantity of the cam ring is increased, and the regulating flow rate (pump discharge quantity) may be increased.

Consequently, for the settings of the orifice diameters of the pilot orifice and the damper orifice, it is not possible to sufficiently attain the reduction of the vibration caused by the relief valve and the reduction of the pressure pulsation in the pressure regulating valve.

It is, therefore, an object of the present invention to provide a variable displacement pump devised to solve the above mentioned problems, to suppress a vibration caused by a relief valve, and to suppress heating of the pump by reduction of pulsation and reduction of the torque by selecting appropriate values of orifice diameters of a pilot orifice and a damper orifice.

According to one aspect of the present invention, a variable displacement pump comprises: a pump body; a drive shaft rotatably supported by the pump body; a rotor which is disposed within the pump body, which is driven by the drive shaft, which has a circumference portion formed with a plurality of slots, and which is provided with a plurality of vanes each received in one of the slots, and each arranged to be slid in a radial direction; a cam ring disposed radially outside the rotor, arranged to be moved within the pump body, and to define a plurality of pump chambers with the vanes and the rotor; a first plate member and a second plate member disposed axially on both sides of the cam ring; an inlet port formed in at least one of the first plate member and the second plate member, and opened in a region in which volumes of the pump chambers are increased; an outlet port formed in at least one of the first plate member and the second plate member, and opened in a region in which the volumes of the pump chambers are decreased; a first fluid pressure chamber which is partitioned by the cam ring, which is formed in a first region radially outside of the cam ring, and whose a volume increases as an eccentric quantity of the cam ring decreases; a second fluid pressure chamber which is partitioned by the cam ring, which is formed in a second region opposite to the first region, radially outside of the cam ring, and whose a volume decreases as the eccentric quantity of the cam ring decreases; a metering orifice provided in a discharge passage connected with the outlet port; a pressure regulating section arranged to regulate the pressure introduced into one of the first fluid pressure chamber and the second fluid pressure chamber, the pressure regulating section including: a high pressure chamber into which a pressure on an upstream side of the metering orifice is introduced; a middle pressure chamber into which a pressure on a downstream side of the metering orifice is introduced; and a low pressure chamber connected with a reservoir tank storing a hydraulic fluid; a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value; a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm, the pilot orifice and the damper orifice satisfying the following relationships:

$$a+2b-2.1\geqq 0,\ -4a+b-16.3\leqq 0,\ \text{and}\ a\leqq 1.8$$

where a represents the first diameter of the pilot orifice, and b represents the second diameter of the damper orifice.

According to another aspect of the invention, a variable displacement pump comprises: a pump body; a drive shaft rotatably supported by the pump body; a rotor which is disposed within the pump body, which is driven by the drive shaft, which has a circumference portion formed with a plurality of slots, and which is provided with a plurality of vanes each received in one of the slots, and each arranged to be slid in a radial direction; a cam ring disposed radially outside the rotor, arranged to be moved within the pump body, and to define a plurality of pump chambers with the vanes and the rotor; a first plate member and a second plate member disposed axially on both sides of the cam ring; an inlet port formed in at least one of the first plate member and the second plate member, and opened in a region in which volumes of the pump chambers are increased; an outlet port formed in at least one of the first plate member and the second plate member, and opened in a region in which the volumes of the pump chambers are decreased; a first fluid pressure chamber which is partitioned by the cam ring, which is formed in a first region radially outside of the cam ring, and whose a volume increases as an eccentric quantity of the cam ring decreases; a second fluid pressure chamber which is partitioned by the cam ring, which is formed in a second region opposite to the first region, radially outside of the cam ring, and whose a volume decreases as the eccentric quantity of the cam ring decreases; a metering orifice provided in a discharge passage connected with the outlet port; a pressure regulating section arranged to regulate the pressure introduced into one of the first fluid pressure chamber and the second fluid pressure chamber, the pressure regulating section including: a high pressure chamber into which a pressure on an upstream side of the metering orifice is introduced; a middle pressure chamber into which a pressure on a downstream side of the metering orifice is introduced; and a low pressure chamber connected with a reservoir tank storing a hydraulic fluid; a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value; a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm, the pilot orifice and the damper orifice satisfying the following relationships: $1.3\leqq a\leqq 1.8$ and $1.6\leqq b\leqq 1.9$ where a represents the first diameter of the pilot orifice, and b represents the second diameter of the damper orifice.

According to still another aspect of the invention, a variable displacement pump comprises: a pump body; a drive shaft rotatably supported by the pump body; a rotor which is disposed within the pump body, which is driven by the drive shaft, which has a circumference portion formed with a plurality of slots, and which is provided with a plurality of vanes each received in one of the slots, and each arranged to be slid in a radial direction; a cam ring disposed radially outside the rotor, arranged to be moved within the pump body, and to define a plurality of pump chambers with the vanes and the rotor; a first plate member and a second plate member disposed axially on both sides of the cam ring; an inlet port formed in at least one of the first plate member and the second plate member, and opened in a region in which volumes of the pump chambers are increased; an outlet port formed in at least one of the first plate member and the second plate member, and opened in a region in which the volumes of the pump chambers are decreased; a first fluid pressure chamber which is partitioned by the cam ring, which is formed in a first region radially outside of the cam ring, and whose a volume increases as an eccentric quantity of the cam ring decreases; a second fluid pressure chamber which is partitioned by the cam ring, which is formed in a second region opposite to the first region, radially outside of the cam ring, and whose a volume decreases as the eccentric quantity of the cam ring decreases; a metering orifice provided in a discharge passage connected with the outlet port; a pressure regulating section arranged to regulate the pressure introduced into one of the first fluid pressure chamber and the second fluid pressure chamber, the pressure regulating section including: a high pressure chamber into which a pressure on an upstream side of the metering orifice is introduced; a middle pressure chamber into which a pressure on a downstream side of the metering orifice is introduced; and a low pressure chamber connected with a reservoir tank storing a hydraulic fluid; a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value; a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm, the pilot orifice and the damper orifice satisfying the following relationships: $1.7\leqq a\leqq 1.8$ and $1.3\leqq b\leqq 2.9$ where a represents the first diameter of the pilot orifice, and b represents the second diameter of the damper orifice.

According to still another aspect of the invention, a variable displacement pump having a discharge flow rate characteristic of 7~8 l at a pump rotational speed of 1000 rpm, the variable displacement pump comprises: a pump body; a drive shaft rotatably supported by the pump body; a rotor which is disposed within the pump body, which is driven by the drive shaft, which has a circumference portion formed with a plurality of slots, and which is provided with a plurality of vanes each received in one of the slots, and each arranged to be slid in a radial direction; a cam ring disposed radially outside the rotor, arranged to be moved within the pump body, and to define a plurality of pump chambers with the vanes and the rotor; a first plate member and a second plate member disposed axially on both sides of the cam ring; an inlet port formed in at least one of the first plate member and the second plate member, and opened in a region in which volumes of the pump chambers are increased; an outlet port formed in at least one of the first plate member and the second plate member, and opened in a region in which the volumes of the pump chambers are decreased; a first fluid pressure chamber which is partitioned by the cam ring, which is formed in a first region radially outside of the cam ring, and whose a volume increases as an eccentric quantity of the cam ring decreases; a second fluid pressure chamber which is partitioned by the cam ring, which is formed in a second region opposite to the first region, radially outside of the cam ring, and whose a volume decreases as the eccentric quantity of the cam ring decreases; a metering orifice provided in a discharge passage connected with the outlet port; a pressure regulating section arranged to regulate the pressure introduced into one of the first fluid pressure chamber and the second fluid pressure chamber, the pressure regulating section including: a high pressure chamber into which a pressure on an upstream side of the metering orifice is introduced; a middle pressure chamber into which a pressure on a downstream side of the metering orifice is introduced; and a low pressure chamber connected with a reservoir tank storing a hydraulic fluid; a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value; a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm, the pilot orifice and the damper orifice satisfying the following relationships: $a+2b-2.1 \geqq 0$, $-4a+b-16.3 \leqq 0$, and $a \leqq 1.8$ where a represents the first diameter of the pilot orifice, and b represents the second diameter of the damper orifice.

BRIEF DESCRIPTION OF THE DRAWINGS

FIG. 8 is a table showing experimental results of an increase of a pump flow rate in accordance with the relationship between the diameter of the pilot orifice and the diameter of the damper orifice.

FIG. 9 is a table showing an appropriate combination between the diameter of the pilot orifice and the diameter of the damper orifice based on the experimental tables of FIGS. 7 and 8.

DETAILED DESCRIPTION OF THE INVENTION

Figure 1:
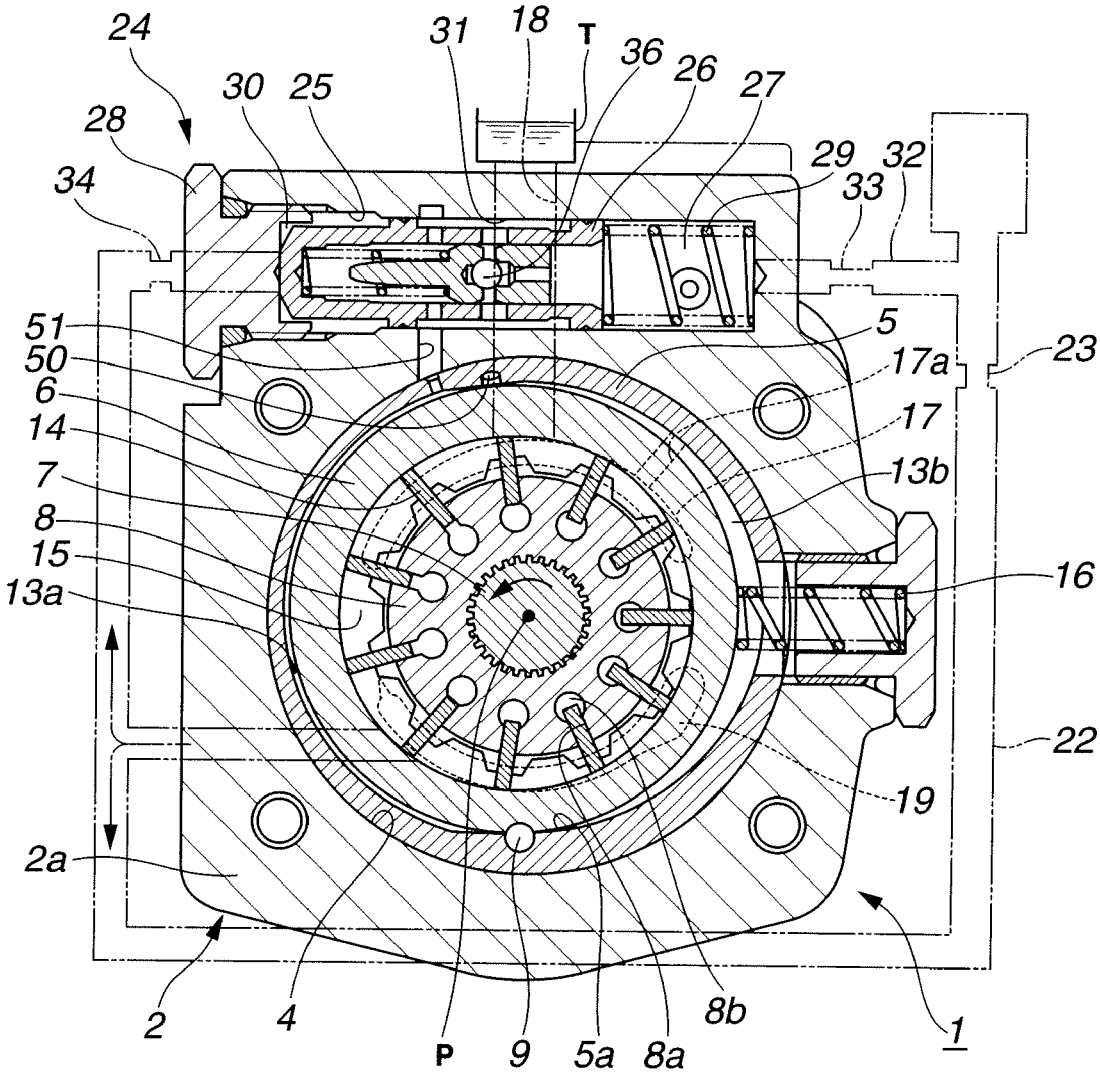
FIG. 1 is a sectional view which shows a variable displacement pump according to an embodiment of the present invention, and which is taken along a section line I-I of FIG. 2.
Figure 2:
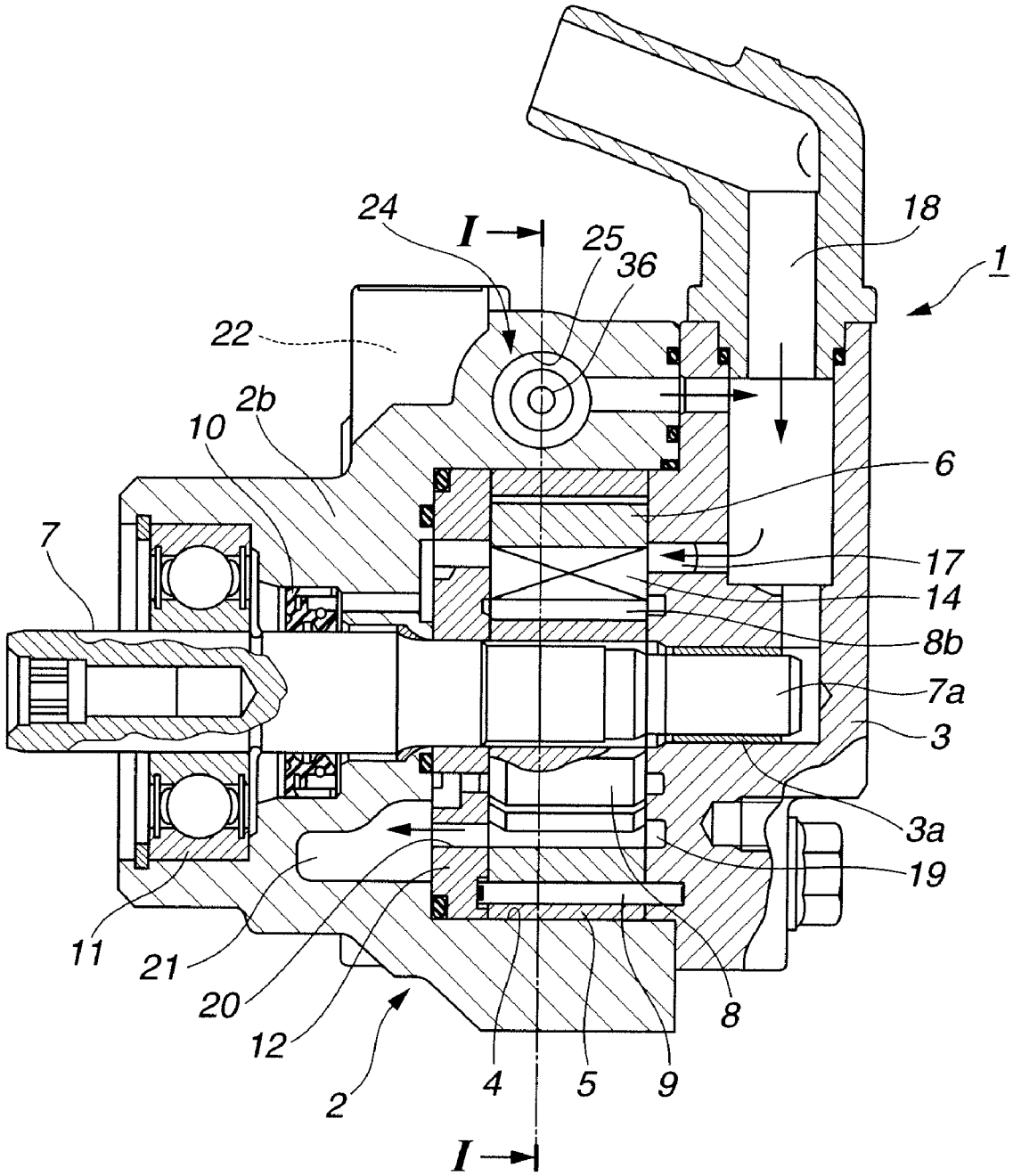
FIG. 2 is a longitudinal sectional view showing the variable displacement pump of FIG. 1.
Figure 3:
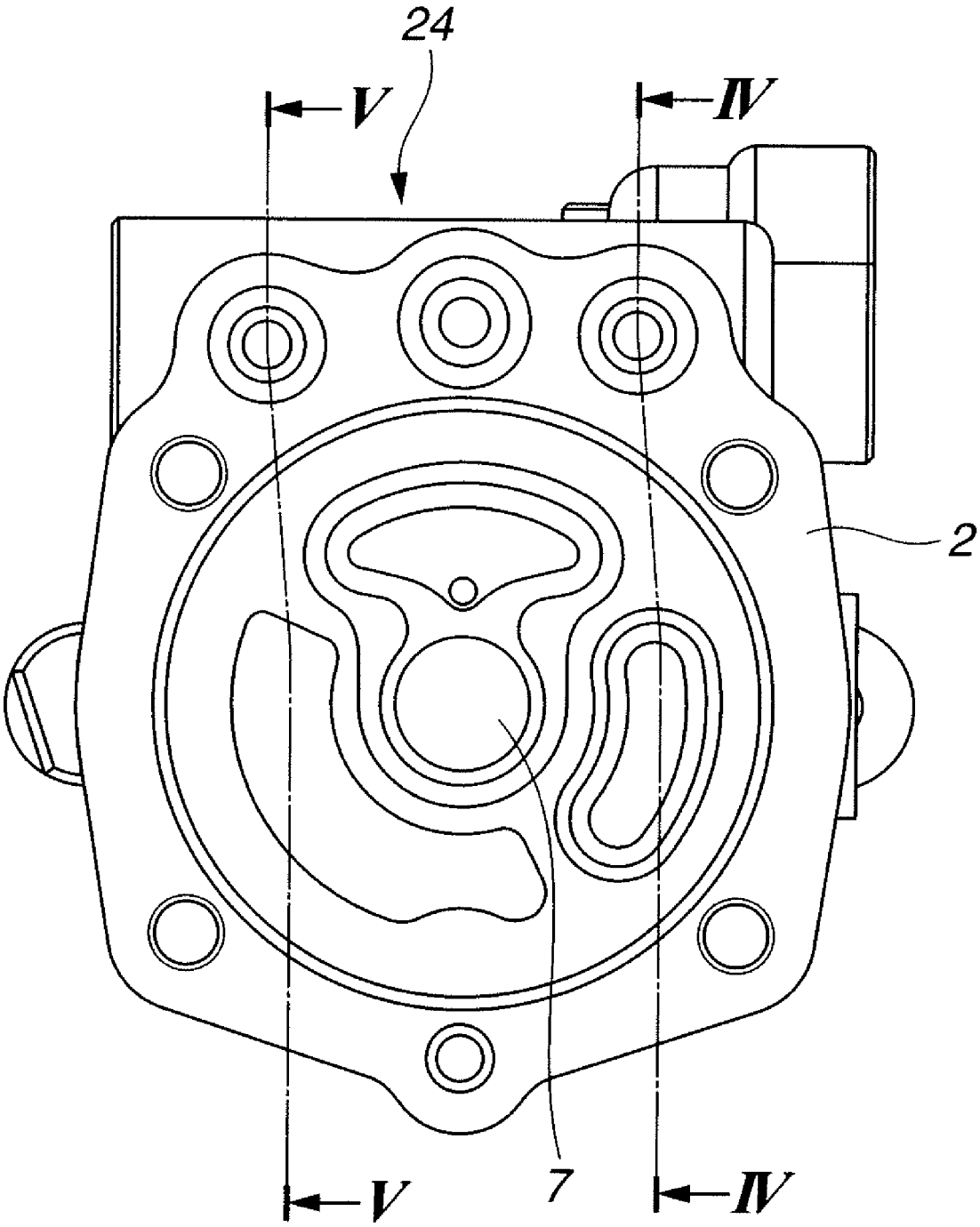
FIG. 3 is a front view showing a front body of the variable displacement pump of FIG. 1.
Figure 4:
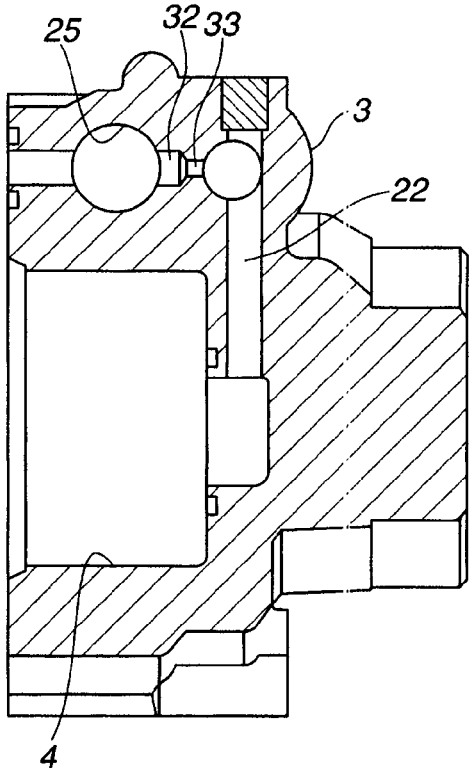
FIG. 4 is a sectional view taken along a section line IV-IV of FIG. 3.
Figure 5:
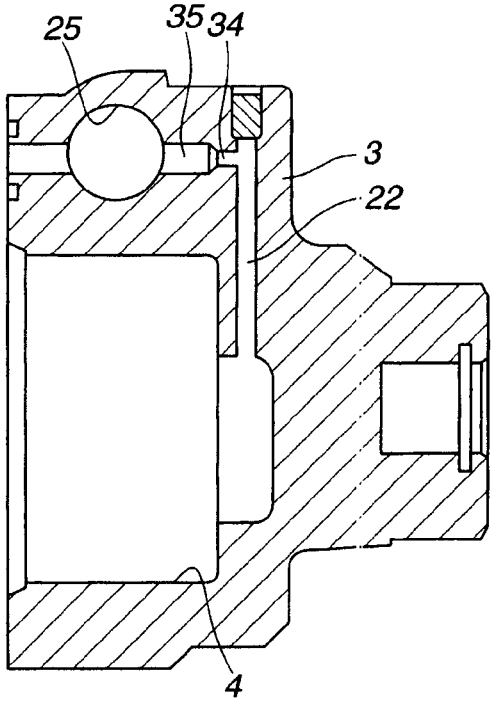
FIG. 5 is a sectional view taken along a section line V-V of FIG. 3.

FIG. 1 is a sectional view which shows a variable displacement pump according to an embodiment of the present invention, and which is taken along a section line I-I of FIG. 2. FIG. 2 is a longitudinal sectional view showing the variable displacement pump of FIG. 1. FIG. 3 is a front view showing a front body of the variable displacement pump of FIG. 1. FIG. 4 is a sectional view taken along a section line IV-IV of FIG. 3. FIG. 5 is a sectional view taken along a section line V-V of FIG. 3. This variable displacement pump of FIG. 1 includes a pump body 1 having a front body 2 and a rear body 3 serving as a first plate member; an adapter ring 5 mounted and fixed in a receiving space 4 formed in pump body 1; a cam ring 6 arranged to swing in left and right directions of FIG. 1 within a substantially oval space of adapter ring 5; a driving shaft 7 inserted into and rotatably supported by pump body 1; and a rotor 8 rotatably disposed radially inside cam ring 6, and connected with driving shaft 7 by a serration.

Front body 2 includes an insertion hole which has a stepped shape having a larger diameter portion on the front side (on the left side of FIG. 2), and into which the driving shaft 7 is inserted. On an inner circumference surface of a middle diameter portion at a substantially central portion, there is provided a mechanical seal 10 for sealing the inside of the pump. On an inner circumference surface of a large diameter portion on the front side, there is provided a ball bearing 11 arranged to rotatably support the front side of the drive shaft 7, as shown in FIG. 2. On a bottom portion of receiving space 4, there is provided an annular pressure plate 12 serving as a second plate member held and sandwiched between this bottom portion of receiving space 4 and one side surface of adapter ring 5.

Rear body 3 is formed into a thick plate shape. Rear body 3 includes a bearing hole located at a substantially central portion. On an inner circumference surface of the bearing hole, there is provided a bearing bush 3*a* arranged to support a journal shaft portion 7*a* which is a rear end portion (on the right side in FIG. 2) of driving shaft 7.

Adapter ring 5 is formed of a sintered material. Adapter ring 5 includes an arc support groove formed on an inner circumference surface of adapter ring 5. A position holding pin 9 is provided in the support groove of adapter ring 5 to hold the position of cam ring 6, as shown in FIG. 2. Adapter ring 5 includes a swing support surface 5*a* which has a predetermined area, which is located on the inner circumference surface of adapter ring 5, on the right side of the position holding pin 9 in FIG. 1 (on a second fluid chamber 13*b*'s side), and about which cam ring 6 is swung.

Position holding pin 9 is not a swing point about which cam ring 6 is swung, and serves as a rotation stopper of cam ring 6 with respect to adapter ring 5 to hold the position of cam ring 6.

Cam ring 6 partitions a space between adapter ring 5 and cam ring 6 into a first fluid pressure chamber 13*a* and a second fluid pressure chamber 13*b*, with position holding pin 9 and a sealing member 50 located at a position opposite to position holding pin 9. This cam ring 6 is arranged to be swung about a predetermined position of swing support surface 5*a* of adapter ring 5 to the first fluid pressure chamber 13*a*'s side (the left side in FIG. 1) or to the second fluid pressure chamber 13*b*'s side (the right side in FIG. 1).

This rotor 8 is arranged to be rotated in a counterclockwise direction shown by an arrow of FIG. 1 when driving shaft 7 is driven by an engine (not shown). Rotor 8 includes a plurality of slots 8*a* arranged in a circumferential direction at regular intervals, and each extending in a radial direction. A vane 14 is held in one of slots 8*a* of rotor 8 to be slid in the radial direction (in a direction of the inner circumference of the cam ring 6). Each vane 14 is a substantially rectangular metal plate. At an inner radial end portion of each slot 8*a*, there is provided a substantially circular back pressure chamber 8*b* integrally formed with the each slot 8*a*.

Cam ring 6, rotor 8, and adjacent two of vanes 14 define a pump chamber 15. The volumes of these pump chambers 15 are decreased or increased by the swing movement of cam ring 6 about the swing support point of swing support surface 5*a*.

On the second fluid pressure chamber 13*b*'s side of front body 2, there is provided a spring 16 held by a spring retainer having a bolt shape. This spring 16 always urges cam ring 6 to the first fluid chamber 13*a*'s side, that is, in a direction in which the volumes of pump chambers 15 are maximized.

On an inside surface of rear body 3 (on the left side in FIG. 2) on the rotor 8's side in an induction region in which the volumes of pump chambers 15 gradually increase in accordance with the rotation of rotor 8, there is formed an arc-shaped inlet port or induction port 17, as shown in FIGS. 1 and 2. This inlet port 17 is arranged to supply, to the pump chambers 15, the hydraulic fluid sucked from reservoir tank T through an inlet or induction passage 18.

On the inside surface on the rotor 8's side (on the left side in FIG. 2) of rear body 3 in a discharge region in which the volumes of pump chambers 15 gradually decrease in accordance with the rotation of rotor 8, there is formed an arc-shaped outlet port or discharge port 19. On an inside surface of pressure plate 12 in the discharge region, there is formed a discharge hole 20 connected with outlet port 19. The pressurized fluid discharged from pump chambers 15 is introduced through outlet port 19 and discharge hole 20 to a discharge side pressure chamber 21 formed in an inside bottom portion of front body 2. The pressurized fluid introduced into discharge side pressure chamber 21 is supplied from an outlet or discharge passage 22 formed in front body 2, through a metering orifice 23 formed on the downstream side of discharge passage 22, through piping (not shown), to the power steering apparatus.

In an upper portion of front body 2, there is provided a control valve or regulating valve 24 directed in a direction perpendicular to driving shaft 7. As shown in FIG. 1, this regulating valve 24 includes a valve hole 25 formed in front body 2; a spool valve 26 slidably received within valve hole 25; a middle pressure chamber 27 formed in one end (right side in FIG. 1) of valve hole 25; a valve spring 29 disposed in middle pressure chamber 27, and arranged to urge spool valve 26 in the leftward direction of FIG. 1 to abut spool valve 26 on a plug 28 disposed on the other end (left side in FIG. 1) of valve hole 25; a high pressure chamber 30 which is formed between plug 28 and an end portion of spool valve 26, and which receives the hydraulic fluid pressure on the upstream side of metering orifice 23, that is, the pressurized fluid in outlet port 19; and a cylindrical low pressure chamber 31 formed between valve hole 25 and forward and rearward land portions of spool valve 26.

A branch passage 32 is bifurcated from the downstream side of metering orifice 23 of outlet passage 22, and connected with the middle pressure chamber 27. In branch passage 32, there is formed a pilot orifice 33 having a small circular section, and arranged to regulate a flow rate of the pressurized fluid relieved from a relief valve 36 described later to a reservoir tank T.

This pilot orifice 33 is formed by a drill with a small diameter at an end portion (on the discharge passage 22's side) of branch passage 32 which has a large diameter, and which is formed by a drill and so on from a direction perpendicular to discharge passage 22 extending in front body 2 in the upward and downward directions, as shown in FIGS. 3 and 4. Accordingly, it is possible to readily form pilot orifice 33.

Between metering orifice 23 and high pressure chamber 30, there is provided a damper orifice 34 having a small circular section. Damper orifice 34 is arranged to decrease the pressure of the pressurized fluid introduced into high pressure chamber 30, and thereby to decrease the pulsation of the pressurized fluid.

This damper orifice 34 is formed by a drill with a small diameter at an end portion (on the discharge passage 22's side) of a branch passage 35 which has a large diameter, and which is formed on the downstream side of discharge passage 22 by a drill and so on from a direction perpendicular to discharge passage 22 extending in front body 2 in the upward and downward directions, as shown in FIGS. 3 and 5. Accordingly, it is possible to readily form damper orifice 34.

On the other hand, the pressurized fluid on the downstream side of metering orifice 23 is supplied to middle pressure chamber 27 receiving valve spring 29. When a pressure difference between middle pressure chamber 27 and high pressure chamber 30 is equal to or greater than a predetermined value, spool valve 26 is moved in the rightward direction of FIG. 1 against the urging force of valve spring 29.

First fluid pressure chamber 13*a* is connected through a connection passage 51 to low pressure chamber 31 of valve hole 25 when spool valve 26 is in the left position. The low pressure is introduced into low pressure chamber 31 through a low pressure passage (not shown) bifurcated from induction passage 18 in front body 2. Moreover, low pressure chamber 31 is gradually closed when spool valve 26 is slid to the right position of FIG. 1 by the pressure difference. Then, first fluid pressure chamber 13*a* is connected with high pressure chamber 30, and the pressurized fluid with the high pressure is introduced into first fluid pressure chamber 13*a*. Consequently, the pressure of low pressure chamber 31 and the pressure on the upstream side of metering orifice 23 are selectively supplied.

On the other hand, second fluid pressure chamber 13*b* is connected with induction passage 18 through a connection groove 17*a* extending radially outwards from a portion of induction port 17 on the second fluid pressure chamber 13*b*' side, so that the low pressure on the induction side is always introduced into second fluid pressure chamber 13*b*.

Within spool valve 26, there is provided a relief valve 36 arranged to open to escape the pressurized fluid into induction passage 18 to circulate through (around) the inside when the pressurized fluid introduced through pilot orifice 33 into middle pressure chamber 27 is equal to or greater than a predetermined pressure, that is, when the activation pressure of the power steering apparatus is equal to or greater than a predetermined pressure.

An inside diameter of pilot orifice 33 and an inside diameter of damper orifice 34 are set by results obtained from experiments described below.

Figures 6, 7:
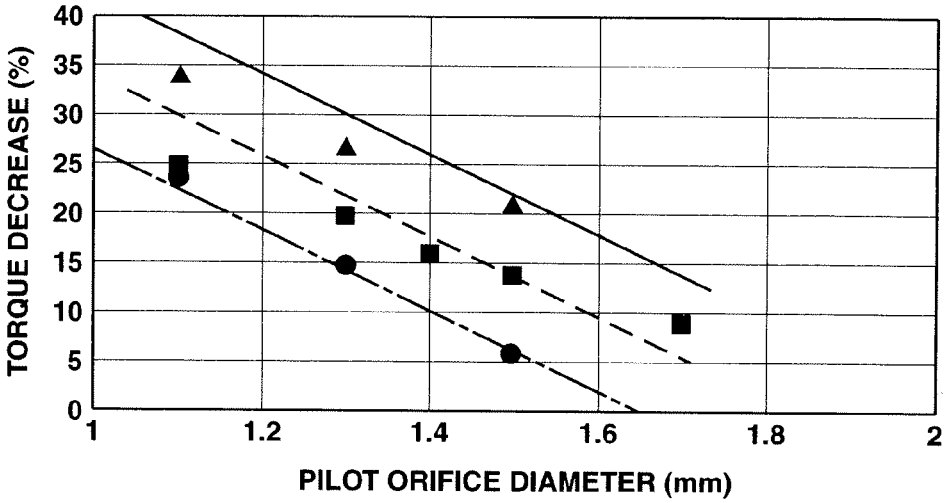
FIG. 6 is a characteristic graph showing a torque decrease quantity in accordance with a combination between a diameter of a pilot orifice and a diameter of a damper orifice.
FIG. 7 is a table showing experimental results of a hydraulic pressure variation in accordance with a relationship between the diameter of the pilot orifice and the diameter of the damper orifice.

FIG. 6 shows, by experiments, a relationship between a torque decrease, the diameter of pilot orifice 33, and the diameter of damper orifice 34 (hereinafter, a P-diameter represents the diameter of pilot orifice 33, and a D-diameter represents the diameter of damper orifice 34). In FIG. 6, triangle points represent that the D-diameter is 2.1 mm, square points represent that the D-diameter is 1.8 mm, and circular points represent that the D-diameter is 1.6 mm. The torque decrease (%) is a rate with respect to a torque decrease when the P-diameter is 1.9 mm and the D-diameter is 2.1 mm.

In this experimental results, in any of the D-diameter and 1.7 mm of the P-diameter which is relatively large, the torque decrease is substantially 10% which is small. The torque decrease quantity increases as the P-diameter decreases from 1.6 mm to 1.1 mm. Accordingly, the torque decrease quantity increases as the length of the P-diameter decreases.

FIG. 7 shows, by experiments, a relationship between the hydraulic pressure variation (pulsation) and the relative length between the P diameter and the D-diameter. In this experiments, the P diameter is set to 1.1~1.8 mm, and the D-diameter is set to 1.1~2.0 mm.

Figure 10:
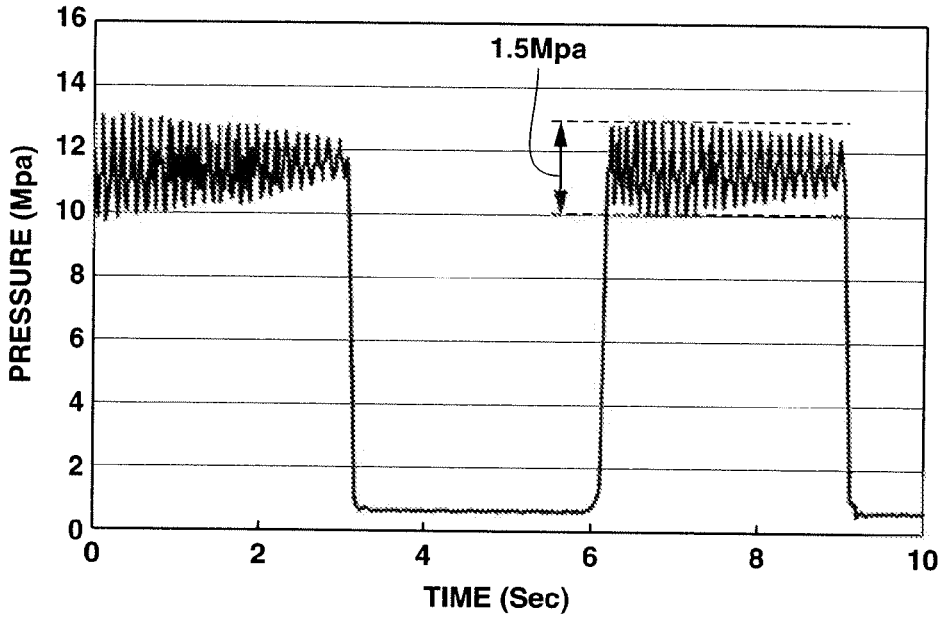
FIG. 10 is a waveform diagram showing a pressure waveform at a relief state when the hydraulic pressure variation is large.
Figure 11:
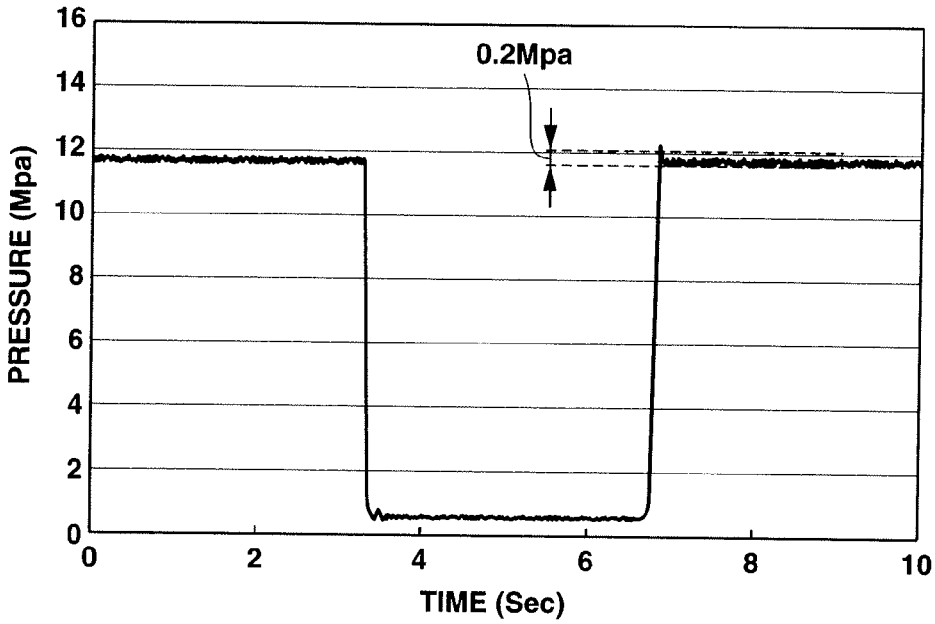
FIG. 11 is a waveform diagram showing a pressure waveform at the relief state when the hydraulic pressure variation is small.

In shaded (mesh) regions of FIG. 7, the variation range becomes equal to or greater than substantially 0.7 MPa. For example, in a case of substantially 1.5 MPa shown in FIG. 10, this is a large problematical range for the vehicle. In diagonally shaded (oblique line) regions of FIG. 7, the variation range becomes substantially 0.5~0.6 MPa. This is not problematical range, and is an allowable range for the vehicle. In hollow regions of FIG. 7, the variation range is smaller than substantially 0.4 MPa. For example, in a case of substantially 0.2 MPa shown in FIG. 11, this is not the problematical range at all for the vehicle.

From these results, in case of 1.1 mm of the P diameter, 1.1~1.7 mm of the D-diameter is the allowable range. In case of 1.3 mm~1.6 mm of the P-diameter, 2.0 mm of the D-diameter is not the allowable range for the large variation range (shown as the mesh regions of FIG. 7). A range other than 2.0 mm of the D-diameter is the allowable range. In case of 1.7 mm and 1.8 mm of the P-diameter, any of the D-diameter are the allowable range.

FIG. 8 shows, by experiments, a relationship between relative lengths of the P-diameter and the D-diameter, pump rotational speed N, and an increasing quantity of discharge flow rates Q at low pressure state and at high pressure state of the pump discharge pressure. In this experiments, the P-diameter is set to 1.1~1.8 mm, and the D-diameter is set 1.1~2.0 mm.

Figure 12:
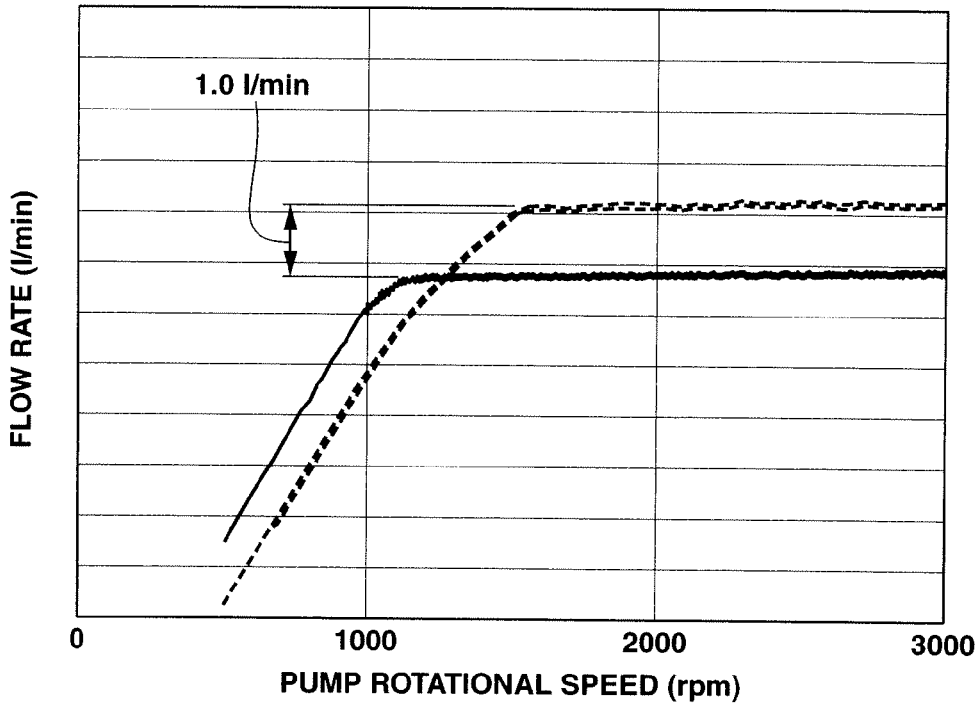
FIG. 12 is a waveform diagram showing a characteristic waveform of the pump flow rate in case of a large difference between the flow rates at a low pressure state and at a high pressure state.
Figure 13:
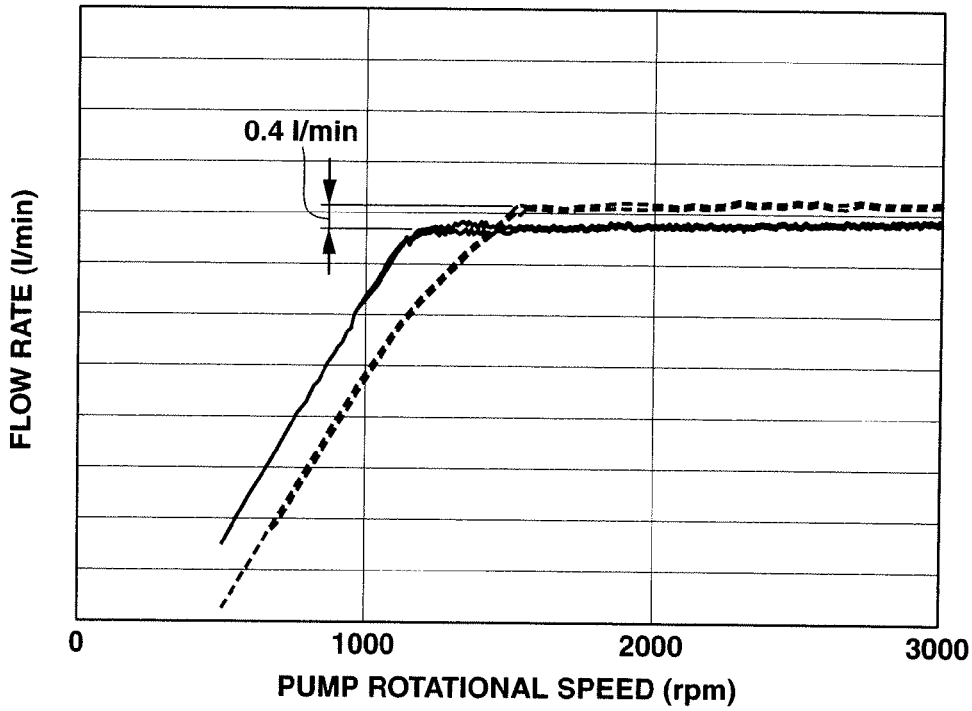
FIG. 13 is a waveform diagram showing a characteristic waveform of the pump flow rate in case of a small difference between the flow rates at the low pressure state and at the high pressure state.

In FIG. 8, in shaded (mesh) regions, the increasing flow rate becomes equal to or greater than 0.7 l/min with respect to NQ peak level at 1 MPa. FIG. 12 shows the flow rate with respect to the pump rotational speed. As shown in FIG. 12, the large difference value of substantially 1.0 l/min between the flow rates (l/min) (liter per minute) with respect to the pump rotational speed at the low pressure state (solid line) and at the high pressure state (broken line) is caused. Accordingly, the heating quantity of the pump is increased by increasing the pump torque. Moreover, in diagonally shaded regions of FIG. 8, the increasing flow rate becomes substantially 0.5~0.6 l/min, and the difference between the flow rates at the low pressure state and at the high pressure state does not become large. This is the allowable range. Moreover, in hollow regions of FIG. 8, the increasing flow rate is within substantially 0.4 l/min. As shown in FIG. 13, the sufficient small difference of substantially 0.4 l/min between the flow rates (l/min) with respect to the pump rotational speed at the low pressure state (solid line) and at the high pressure state (broken line) is caused. Accordingly, in this region, the increase of the pump torque is suppressed, and the heating quantity is decreased.

Accordingly, in this embodiment, as shown in FIG. 9, the experimental results shown in FIGS. 7 and 8 are superimposed to relatively select the P-diameter and the D-diameter which are in the hollow regions and in the diagonally shaded regions, and which are in the allowable range with respect to the hydraulic pressure variation or the hydraulic pressure fluctuation (cf. FIG. 7) and in the allowable range with respect to the increasing flow rate (cf. FIG. 8).

As shown in FIG. 9, when the P-diameter is set to 1.1 mm, the D-diameter is set to 1.6 mm or 1.7 mm. When the P-diameter is set to 1.3 mm, the D-diameter is set to a range of 1.6~1.9 mm. When the P-diameter is set to 1.4 mm or 1.5 mm, the D-diameter is set to a range of 1.5~1.9 mm. When the P-diameter is set to 1.6 mm, the D-diameter is set to a relatively wide range of 1.4~1.9 mm. Moreover, when the P-diameter is set to 1.7 mm or 1.8 mm, the D-diameter is a wider range of 1.3~2.0 mm.

In particular, in a case in which the P-diameter is set to 1.4 mm or 1.5 mm and the D-diameter is set to 1.7 mm or 1.8 mm, in a case in which the P-diameter is set to 1.6 mm and the D-diameter is set to 1.6~1.8 mm, in a case in which the P-diameter is set to 1.7 mm and the D-diameter is set to 1.6~1.9 mm, and in a case in which the P-diameter is set to 1.8 mm and the D-diameter is set to 1.5~1.9 mm, that is, the hollow regions of FIG. 9 are most favorable states. In these cases, the variation range of the pressurized fluid is smallest, and the difference of the increasing quantities is smallest.

Accordingly, it is possible to effectively suppress the vibration caused by pilot orifice 33 at the relief. Moreover, it is possible to decrease the pump torque by the decrease of the relief quantity, and to sufficiently decrease the heating quantity. Therefore, it is possible to attain the energy conservation.

Similarly, it is possible to effectively suppress the pulsation of the pressurized fluid within pressure regulating valve 24 by damper orifice 34, and to prevent the pressure decrease of high pressure chamber 30. Therefore, it is possible to regulate the pump discharge quantity through cam ring 6 at high accuracy.

In a case in which the pilot orifice 33 has a circular section with a first diameter (a mm) and the damper orifice 34 has a circular section with a second diameter (b mm), these hollow regions and the diagonally shaded regions are represented by mathematical expressions as follows:

$$a+2b-2.1 \geqq 0$$

$$-4a+b-16.3 \leqq 0 \text{ and}$$

$$a \leqq 1.8$$

where a is the first diameter of the circular section of pilot orifice 33, and b is the second diameter of the circular section of damper orifice 34.

The hollow regions are represented by mathematical expressions as follows:

$$3a+5b \geqq 0 \text{ and } -3a+5b-4.8 \leqq 0.$$

Accordingly, it is possible to further decrease the vibration caused by the relief valve, and to suppress the pulsation.

In a case in which the P diameter is set equal to or smaller than 1.5 mm in the diagonally shaded regions and the hollow regions, it is possible to sufficiently suppress the relief quantity of the pressurized fluid, and thereby to further decrease the pump torque.

In a case in which the P-diameter is set equal to or greater than 1.7 mm in the diagonally shaded regions and the hollow regions, it is possible to obtain stable performance quality because this region is a region with the high tolerance to the error of the design.

In a case in which the D-diameter is set to the range of 1.7 mm~1.8 mm in the diagonally shaded regions and the hollow regions, a selectable range of the P-diameter becomes large, and it is possible to improve the freedom of selection.

In a case in which the P-diameter is set equal to or smaller than 1.4 mm, a selectable range of the D-diameter becomes small. However, the torque decrease quantity becomes large, and accordingly it is possible to effectively suppress the pump heating quantity.

In the diagonally shaded regions and the hollow regions, the pilot orifice having a circular section of a first diameter of a mm and the damper orifice having a circular section of a second diameter of b mm satisfy the following relationships:

$$1.3 \leqq a \leqq 1.8 \text{ and } 1.6 \leqq b \leqq 1.9$$

where a represents the first diameter of the pilot orifice, and b represents the second diameter of the damper orifice.

Accordingly, it is possible to select the P-diameter and the D-diameter freely in the diagonally shaded regions and the hollow regions. By these selected values, it is possible to ensure the reduction of the pressure pulsation and the reduction of the vibration in relief valve 36, and to freely adjust the increasing quantity of the pump discharge flow rate of the torque decreasing quantity. Accordingly, it is possible to improve the freedom of the adjustment.

The present invention is not limited to the above-described embodiments. In the embodiment, the low pressure type pump arranged to introduce the low pressure to the second fluid pressure chamber 13*b* is employed. The present invention is applicable to various pumps such as a total pressure type pump arranged to introduce the pressure from the pressure regulating valve 24 to the fluid pressure chambers 13*a* and 13*b*.

The variable displacement pump according to thepresent invention includes: the pump body 1; the drive shaft 7 rotatably supported by the pump body 1; the rotor 8 which is disposed within the pump body 1, which is driven by the drive shaft 7, which has a circumference portion formed with a plurality of slots 8*a*, and which is provided with the plurality of vanes 14 each received in one of the slots 8*a*, and each arranged to be slid in a radial direction; the cam ring 6 arranged to be moved within the pump body 1, and to define a plurality of pump chambers 15 with the vanes 14 and the rotor 8; the first plate member 3 and the second plate member 12 disposed axially on both sides of the cam ring 6; the inlet port 17 formed in at least one of the first plate member 3 and the second plate member 12, and opened in a region in which volumes of the pump chambers 15 are increased; the outlet port 19 formed in at least one of the first plate member 3 and the second plate member 12, and opened in a region in which the volumes of the pump chambers 15 are decreased; the first fluid pressure chamber 13*a* which is partitioned by the cam ring 6, which is formed in a first region radially outside of the cam ring 6, and whose a volume increases as an eccentric quantity of the cam ring 6 decreases; the second fluid pressure chamber 13*b* which is partitioned by the cam ring 6, which is formed in a second region opposite to the first region, radially outside of the cam ring 6, and whose a volume decreases as the eccentric quantity of the cam ring 6 decreases; the metering orifice 23 provided in a discharge passage 22 connected with the outlet port 19; the pressure regulating section 24 arranged to regulate the pressure introduced into one of the first fluid pressure chamber 13*a* and the second fluid pressure chamber 13*b*, the pressure regulating section 24 including: the high pressure chamber 30 into which a pressure on an upstream side of the metering orifice 23 is introduced; the middle pressure chamber 27 into which a pressure on a downstream side of the metering orifice 23 is introduced; and the low pressure chamber 31 connected with a reservoir tank T storing a hydraulic fluid; the relief valve 36 provided between the reservoir tank T and the metering orifice 23, on the downstream side of the metering orifice 23, and arranged to open to discharge the pressure on the downstream side of the metering orifice 23 to the reservoir tank T when the pressure of the middle pressure chamber 27 is equal to or greater than a predetermined value; the pilot orifice 33 provided in a passage connecting the metering orifice 23 and the middle pressure chamber 27, the pilot orifice 33 having a circular section with a first diameter of a mm; and the damper orifice 34 provided in a passage connecting the outlet port 19 and the high pressure chamber 30, the damper orifice 34 having a circular section with a second diameter of b mm, the pilot orifice 33 and the damper orifice 34 satisfying the following relationships:

$$a+2b-2.1 \geqq 0,$$

$$-4a+b-16.3 \leqq 0, \text{ and}$$

$$a \leqq 1.8$$

where a represents the first diameter of the pilot orifice, and b represents the second diameter of the damper orifice.

In this apparatus according to the present invention, the pilot orifice and the damper orifice are formed to satisfy the above-mentioned conditions. Therefore, it is possible to decrease the vibration caused by the relief valve, and to suppress the pulsation.

Besides, the sections of the pilot orifice and the damper orifice are not limited to the circular sections. It is optional to employ another sectional shapes which have an area identical to the area of the circular section.

This application is based on a prior Japanese Patent Application No. 2007-244736. The entire contents of the Japanese Patent Application No. 2007-244736 with a filing date of Sep. 21, 2007 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump comprising:

a pump body;

a drive shaft rotatably supported by the pump body;

a rotor which is disposed within the pump body, which is driven by the drive shaft, which has a circumference portion formed with a plurality of slots, and which is provided with a plurality of vanes each received in one of the slots, and each arranged to be slid in a radial direction;

a cam ring disposed radially outside the rotor, arranged to be moved within the pump body, and to define a plurality of pump chambers with the vanes and the rotor;

a first plate member and a second plate member disposed axially on both sides of the cam ring;

an inlet port formed in at least one of the first plate member and the second plate member, and opened in a region in which volumes of the pump chambers are increased;

an outlet port formed in at least one of the first plate member and the second plate member, and opened in a region in which the volumes of the pump chambers are decreased;

a first fluid pressure chamber which is partitioned by the cam ring, which is formed in a first region radially outside of the cam ring, and whose volume increases as an eccentric quantity of the cam ring decreases;

a second fluid pressure chamber which is partitioned by the cam ring, which is formed in a second region opposite to the first region, radially outside of the cam ring, and whose volume decreases as the eccentric quantity of the cam ring decreases;

a metering orifice provided in a discharge passage connected with the outlet port;

a pressure regulating section arranged to regulate the pressure introduced into one of the first fluid pressure chamber and the second fluid pressure chamber, the pressure regulating section including:

a high pressure chamber into which a pressure on an upstream side of the metering orifice is introduced;

a middle pressure chamber into which a pressure on a downstream side of the metering orifice is introduced; and a low pressure chamber connected with a reservoir tank storing a hydraulic fluid;

a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value;

a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm and the damper orifice configured to decrease a pressure variation of a pressurized fluid introduced into the high pressure chamber, the pilot orifice and the damper orifice satisfying the following relationships:

$$a+2b-2.1 \geqq 0,$$

$$-4a+b-16.3 \leqq 0 \text{ and}$$

$$a \leqq 1.8$$

where a represents the first diameter of the pilot orifice, and b represents the second diameter of the damper orifice.

2. The variable displacement pump as claimed in claim 1, wherein the pilot orifice and the damper orifice satisfy the following relationships:

$$3a+5b \geqq 0 \text{ and } -3a+5b-4.8 \leqq 0.$$

3. The variable displacement pump as claimed in claim 2, wherein the first diameter of the pilot orifice is set equal to or smaller than 1.5 mm.

4. The variable displacement pump as claimed in claim 2, wherein the first diameter of the pilot orifice is set equal to or greater than 1.7 mm.

5. The variable displacement pump as claimed in claim 4, wherein the second diameter of the damper orifice is set in a range between 1.7 mm and 1.8 mm.

6. The variable displacement pump as claimed in claim 5, wherein the first diameter of the pilot orifice is set to 1.7 mm, and the second diameter of the damper orifice is set to 1.8 mm.

7. The variable displacement pump as claimed in claim 1, wherein the first diameter of the pilot orifice is set equal to or smaller than 1.4 mm.

8. A variable displacement pump comprising:

a pump body;

a drive shaft rotatably supported by the pump body;

a rotor which is disposed within the pump body, which is driven by the drive shaft, which has a circumference portion formed with a plurality of slots, and which is provided with a plurality of vanes each received in one of the slots, and each arranged to be slid in a radial direction;

a cam ring disposed radially outside the rotor, arranged to be moved within the pump body, and to define a plurality of pump chambers with the vanes and the rotor;

a first plate member and a second plate member disposed axially on both sides of the cam ring;

an inlet port formed in at least one of the first plate member and the second plate member, and opened in a region in which volumes of the pump chambers are increased;

an outlet port formed in at least one of the first plate member and the second plate member, and opened in a region in which the volumes of the pump chambers are decreased;

a first fluid pressure chamber which is partitioned by the cam ring, which is formed in a first region radially outside of the cam ring, and whose volume increases as an eccentric quantity of the cam ring decreases;

a second fluid pressure chamber which is partitioned by the cam ring, which is formed in a second region opposite to the first region, radially outside of the cam ring, and whose volume decreases as the eccentric quantity of the cam ring decreases;

a metering orifice provided in a discharge passage connected with the outlet port;

a pressure regulating section arranged to regulate the pressure introduced into one of the first fluid pressure chamber and the second fluid pressure chamber, the pressure regulating section including:

a high pressure chamber into which a pressure on an upstream side of the metering orifice is introduced;

a middle pressure chamber into which a pressure on a downstream side of the metering orifice is introduced; and a low pressure chamber connected with a reservoir tank storing a hydraulic fluid;

a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value;

a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm and the damper orifice configured to decrease a pressure variation of a pressurized fluid introduced into the high pressure chamber, the pilot orifice and the damper orifice satisfying the following relationships:

$$1.3 \leqq a \leqq 1.8 \text{ and } 1.6 \leqq b \leqq 1.9$$

where a represents the first diameter of the pilot orifice, and b represents the second diameter of the damper orifice.

9. The variable displacement pump as claimed in claim 8, wherein the first diameter of the pilot orifice is set equal to or greater than 1.6 mm.

10. The variable displacement pump as claimed in claim 8, wherein the first diameterof the pilot orifice is set equal to or smaller than 1.4 mm.

11. A variable displacement pump comprising:

a pump body;

a drive shaft rotatably supported by the pump body;

a rotor which is disposed within the pump body, which is driven by the drive shaft, which has a circumference portion formed with a plurality of slots, and which is provided with a plurality of vanes each received in one of the slots, and each arranged to be slid in a radial direction;

a cam ring disposed radially outside the rotor, arranged to be moved within the pump body, and to define a plurality of pump chambers with the vanes and the rotor;

a first plate member and a second plate member disposed axially on both sides of the cam ring;

an inlet port formed in at least one of the first plate member and the second plate member, and opened in a region in which volumes of the pump chambers are increased;

an outlet port formed in at least one of the first plate member and the second plate member, and opened in a region in which the volumes of the pump chambers are decreased;

a first fluid pressure chamber which is partitioned by the cam ring, which is formed in a first region radially outside of the cam ring, and whose volume increases as an eccentric quantity of the cam ring decreases;

a second fluid pressure chamber which is partitioned by the cam ring, which is formed in a second region opposite to the first region, radially outside of the cam ring, and whose volume decreases as the eccentric quantity of the cam ring decreases;

a metering orifice provided in a discharge passage connected with the outlet port;

a pressure regulating section arranged to regulate the pressure introduced into one of the first fluid pressure chamber and the second fluid pressure chamber, the pressure regulating section including:

a high pressure chamber into which a pressure on an upstream side of the metering orifice is introduced;

a middle pressure chamber into which a pressure on a downstream side of the metering orifice is introduced; and a low pressure chamber connected with a reservoir tank storing a hydraulic fluid;

a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value;

a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm and the damper orifice configured to decrease a pressure variation of a pressurized fluid introduced into the high pressure chamber, the pilot orifice and the damper orifice satisfying the following relationships:

$$1.7 \leqq a \leqq 1.8 \text{ and } 1.3 \leqq b \leqq 2.9$$

where a represents the first diameter of the pilot orifice, and b represents the second diameter of the damper orifice.

12. The variable displacement pump as claimed in claim 11, wherein the first diameter of the pilot orifice is set to 1.7 mm.

13. The variable displacement pump as claimed in claim 12, wherein the second diameter of the damper orifice is set in a range between 1.6 mm and 1.9 mm.

14. A variable displacement pump having a discharge flow rate characteristic of 7~8 liter at a pump rotational speed of 1000 rpm, the variable displacement pump comprising:

a pump body;

a drive shaft rotatably supported by the pump body;

a rotor which is disposed within the pump body, which is driven by the drive shaft, which has a circumference portion formed with a plurality of slots, and which is provided with a plurality of vanes each received in one of the slots, and each arranged to be slid in a radial direction;

a cam ring disposed radially outside the rotor, arranged to be moved within the pump body, and to define a plurality of pump chambers with the vanes and the rotor;

a first plate member and a second plate member disposed axially on both sides of the cam ring;

an inlet port formed in at least one of the first plate member and the second plate member, and opened in a region in which volumes of the pump chambers are increased;

an outlet port formed in at least one of the first plate member and the second plate member, and opened in a region in which the volumes of the pump chambers are decreased;

a first fluid pressure chamber which is partitioned by the cam ring, which is formed in a first region radially outside of the cam ring, and whose volume increases as an eccentric quantity of the cam ring decreases;

a second fluid pressure chamber which is partitioned by the cam ring, which is formed in a second region opposite to the first region, radially outside of the cam ring, and whose volume decreases as the eccentric quantity of the cam ring decreases;

a metering orifice provided in a discharge passage connected with the outlet port;

a pressure regulating section arranged to regulate the pressure introduced into one of the first fluid pressure chamber and the second fluid pressure chamber, the pressure regulating section including:

a high pressure chamber into which a pressure on an upstream side of the metering orifice is introduced;

a middle pressure chamber into which a pressure on a downstream side of the metering orifice is introduced; and a low pressure chamber connected with a reservoir tank storing a hydraulic fluid;

a relief valve provided between the reservoir tank and the metering orifice, on the downstream side of the metering orifice, and arranged to open to discharge the pressure on the downstream side of the metering orifice to the reservoir tank when the pressure of the middle pressure chamber is equal to or greater than a predetermined value;

a pilot orifice provided in a passage connecting the metering orifice and the middle pressure chamber, the pilot orifice having a circular section with a first diameter of a mm; and a damper orifice provided in a passage connecting the outlet port and the high pressure chamber, the damper orifice having a circular section with a second diameter of b mm and the damper orifice configured to decrease a pressure variation of a pressurized fluid introduced into the high pressure chamber, the pilot orifice and the damper orifice satisfying the following relationships:

$$a+2b-2.1 \geqq 0,$$

$$-4a+b-16.3 \leqq 0 \text{ and}$$

$$a \leqq 1.8$$

where a represents the first diameter of the pilot orifice, and b represents the second diameter of the damper orifice.

15. The variable displacement pump as claimed in claim 14, wherein the pilot orifice and the damper orifice satisfy the following relationships:

$$3a+5b \geqq 0 \text{ and } -3a+5b-4.8 \leqq 0.$$

16. The variable displacement pump as claimed in claim 15, wherein the first diameter of the pilot orifice is set equal to or smaller than 1.5 mm.

17. The variable displacement pump as claimed in claim 15, wherein the first diameter of the pilot orifice is set equal to or greater than 1.7 mm.

18. The variable displacement pump as claimed in claim 17, wherein the second diameter of the damper orifice is set in a range between 1.7 mm and 1.8 mm.

19. The variable displacement pump as claimed in claim 18, wherein the first diameter of the pilot orifice is set to 1.7 mm, and the second diameter of the damper orifice is set to 1.8 mm.

20. The variable displacement pump as claimed in claim 14, wherein the first diameter of the pilot orifice is set equal to or smaller than 1.4 mm.

* * * * *